US008664556B2

(12) United States Patent
Yamamoto et al.

(10) Patent No.: US 8,664,556 B2
(45) Date of Patent: Mar. 4, 2014

(54) SWITCH DEVICE OPERATING MECHANISM

(75) Inventors: Yohei Yamamoto, Chiyoda-ku (JP); Hiroshi Tottori, Chiyoda-ku (JP); Takeaki Yamanaka, Mitoyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 135 days.

(21) Appl. No.: 13/386,702

(22) PCT Filed: Jun. 11, 2010

(86) PCT No.: PCT/JP2010/059915
§ 371 (c)(1),
(2), (4) Date: Jan. 24, 2012

(87) PCT Pub. No.: WO2011/055564
PCT Pub. Date: May 12, 2011

(65) Prior Publication Data

US 2012/0125752 A1 May 24, 2012

(30) Foreign Application Priority Data

Nov. 3, 2009 (JP) ..... 2009-252522

(51) Int. Cl.
*H01H 3/48* (2006.01)

(52) U.S. Cl.
USPC ..... 200/469; 200/400

(58) Field of Classification Search
CPC ..... H01H 33/42; H01H 33/40
USPC ..... 200/400, 401, 500, 501
See application file for complete search history.

(56) References Cited

U.S. PATENT DOCUMENTS

| | | | | |
|---|---|---|---|---|
| 3,382,331 | A * | 5/1968 | Jencks et al. | 200/50.02 |
| 4,152,561 | A * | 5/1979 | Maier et al. | 200/400 |
| 6,080,847 | A * | 6/2000 | Hillman et al. | 536/23.5 |
| 7,943,873 | B2 * | 5/2011 | Gopikrishnan Babu et al. | 200/43.14 |
| 8,106,316 | B2 * | 1/2012 | Manz | 200/43.11 |
| 8,183,485 | B2 * | 5/2012 | Ahn | 200/400 |

FOREIGN PATENT DOCUMENTS

| | | | |
|---|---|---|---|
| JP | 7-296665 | A | 11/1995 |
| JP | 2002-63839 | A | 2/2002 |
| JP | 2005-228713 | A | 8/2005 |

OTHER PUBLICATIONS

International Search Report (PCT/ISA/210) issued on Sep. 7, 2010, by Japanese Patent Office as the International Searching Authority for International Application No. PCT/JP2010/059915.

* cited by examiner

*Primary Examiner* — Kyung Lee
(74) *Attorney, Agent, or Firm* — Buchanan Ingersoll & Rooney PC

(57) ABSTRACT

Included are: a closing spring which provides a closing drive force for closing a contact of a switch device by rotating a camshaft by release of energy; a first semi-circular latch which retains stored energy of the closing spring via a closing lever; an output lever which pivots by being pressed by a cam provided on the camshaft when retention by the first semi-circular latch is released and the energy of the closing spring is released, and transmits the closing drive force to the switch device via a linking mechanism; and a second semi-circular latch which prevents the output lever from pivoting in a tripping direction via a tripping lever and retains stored energy of an interrupting spring provided on the linking mechanism, the pivoting of the output lever being caused by transmission of the stored energy of the interrupting spring.

7 Claims, 8 Drawing Sheets

(a)

(b)

(c)

SWITCH DEVICE OPERATING MECHANISM

TECHNICAL FIELD

The present invention relates to a switch device operating mechanism for a circuit breaker, a switchgear, and the like.

BACKGROUND ART

As a conventional operating mechanism for use in a switch device such as a circuit breaker, for instance, the following technique is disclosed.

An interrupting spring which performs open-circuit operation by release of energy and a closing spring which performs close-circuit operation by release of energy are included; retention of stored energy of the interrupting spring is made to be released by a tripping trigger and accordingly the stored energy is released to perform the open-circuit operation; and retention of stored energy of the closing spring is made to be released by a closing trigger and accordingly the stored energy is released to perform the close-circuit operation. A configuration is made such that the tripping trigger and the closing trigger are independently and rotatably placed on the same trigger shaft; and during a closing state, a load in which a biasing force of the interrupting spring is attenuated is exerted on the tripping trigger by a tripping latch lever which is for retaining the closing state.

RELATED ART DOCUMENT

Patent Document

Patent Document 1: Japanese Unexamined Patent Publication No. 2005-228713 (Second page, FIG. 1)

DISCLOSURE OF INVENTION

Problem to be Solved by the Invention

In the conventional operating device as disclosed in Patent Document 1, a tripping latch is engaged with a pin implanted in an output lever; and accordingly, the closing state is retained. At this time, the distance from an engagement place to a pivot center position of the tripping latch is separated; and therefore, problems exist in that when the direction of line of force is deviated, the latch becomes easy to disengage, position adjustment is troublesome, and it has the potential not to be able to retain the closing state in some cases.

The present invention has been made to solve the problem described above, and an object of the present invention is to provide a switch device operating mechanism in which reliability of a latch section that retains stored energy of closing and interrupting springs in closing and tripping operation is enhanced.

Means for Solving Problem

According to the present invention, there is provided a switch device operating mechanism including: a closing spring which provides a closing drive force for closing a contact of a switch device by rotating a camshaft by release of energy; a first semi-circular latch which retains stored energy of the closing spring via a closing lever, the stored energy being transmitted from the camshaft; an output lever which pivots by being pressed by a cam provided on the camshaft when retention by the first semi-circular latch is released and the energy of the closing spring is released, and transmits the closing drive force to the switch device via a linking mechanism; and a second semi-circular latch which prevents the output lever from pivoting in a tripping direction via a tripping lever and retains stored energy of an interrupting spring provided on the linking mechanism, the pivoting of the output lever being caused by transmission of the stored energy of the interrupting spring.

Advantageous Effect of the Invention

According to the switch device operating mechanism of the present invention, the first semi-circular latch which retains stored energy of the closing spring via the closing lever and the second semi-circular latch which retains stored energy of the interrupting spring via the tripping lever; whereby, the distance from a pivot center of each semi-circular latch to an engagement place can be shortened. Therefore, position adjustment is easy, retention of the stored energy of the closing spring and the interrupting spring can be reliably achieved, and the switch device operating mechanism with high reliability can be obtained.

Furthermore, a load to be exerted on the latch section can be reduced and the latch can be driven by a small drive force.

BRIEF DESCRIPTION OF DRAWINGS

FIG. 10 is a view for explaining the closing operation and the retaining operation of closing of the switch device operating mechanism according to Embodiment 1 of the present invention;

FIG. 11 is a view for explaining the closing operation and the retaining operation of closing of the switch device operating mechanism according to Embodiment 1 of the present invention;

FIG. 12 is a view for explaining the closing operation and the retaining operation of closing of the switch device operating mechanism according to Embodiment 1 of the present invention; and FIG. 13 is a view for explaining the tripping operation of the switch device operating mechanism according to Embodiment 1 of the present invention.

MODE FOR CARRYING OUT THE INVENTION

Embodiment 1

Figure 1:
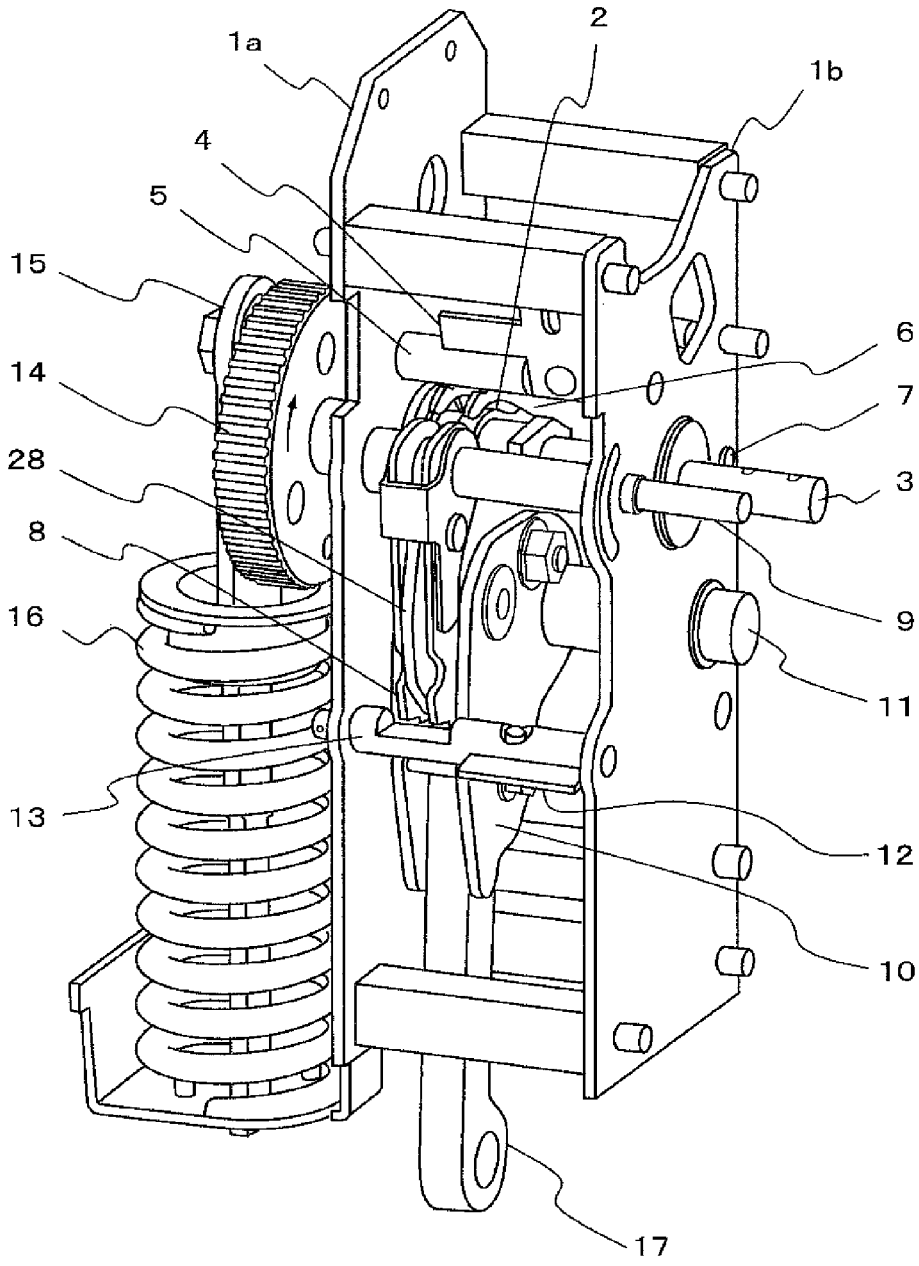
FIG. 1 is a perspective view showing a switch device operating mechanism according to Embodiment 1 of the present invention.

FIG. 1 is a perspective view of a switch device operating mechanism according to Embodiment 1. As the switch device, for instance, a vacuum circuit breaker using a vacuum valve will be described as an example. First, the entire configuration of the operating mechanism will be described by the perspective view of FIG. 1. In this regard, however, there are some components that are difficult to understand their shapes because of being hidden inside the drawing in FIG. 1; and therefore, a mutual arrangement relationship among respective components will be mainly described, and detail of each part will be described by partial drawings of FIG. 2 to FIG. 6.

As shown in FIG. 1, a camshaft 3 to which a cam 2 for transmitting a closing drive force is firmly fixed is disposed between two frames different in shape 1*a*, 1*b*. A first semi-circular latch 5 to which a driving plate 4 is firmly fixed is disposed on the upper side of the camshaft 3; and a closing lever shaft 7 to which a closing lever 6 is firmly fixed is disposed on the rear side of the camshaft 3. Then, a tripping lever pivoting shaft 9 to which a tripping lever 8 is rotatably supported is disposed on the front side of the camshaft 3. Furthermore, an output lever shaft 11 serving as a pivot center of an output lever 10 is disposed on the rearward lower side of the camshaft 3. Further, a second semi-circular latch 13 to which a driving plate 12 is firmly fixed is disposed on the front lower side of the camshaft 3. The aforementioned respective shafts and the respective latches are disposed in parallel with each other in a direction perpendicular to the two frames 1*a*, 1*b*.

A large gear 14 is firmly fixed to an end section of the camshaft 3 protruded outside the frame 1*a*; and a crank rod 15 which performs crank motion with the rotation of the large gear 14 is joined to the large gear 14. Then, a closing spring 16 in which one end is supported on the frame side and the other end expands and contracts in response to the movement of the crank rod 15 and provides the drive force in a closing direction to the large gear 14, is provided.

Figure 5:
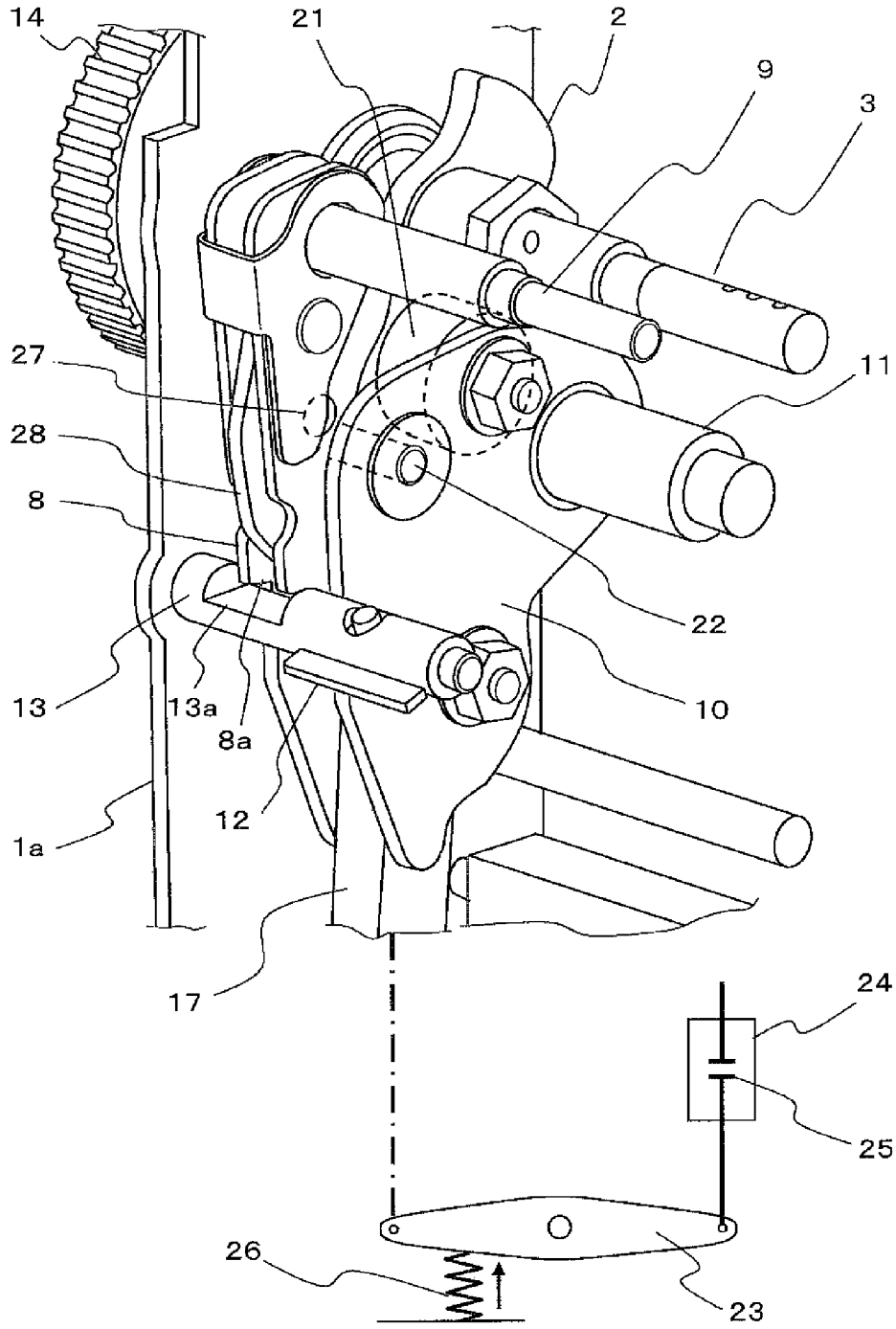
FIG. 5 is a perspective view showing a relevant part (mainly, a retaining mechanism portion in a closing state) of FIG. 1.

Furthermore, one end side of an output link 17 is pivotally and rotatably supported to the output lever 10; and the other end side of the output link 17 is joined to a movable contact of the vacuum valve of the vacuum circuit breaker via a linking mechanism (not shown in the drawing) (see FIG. 5).

Hereinafter, detail of the configuration will be further described by diving into each part.

Figure 2:
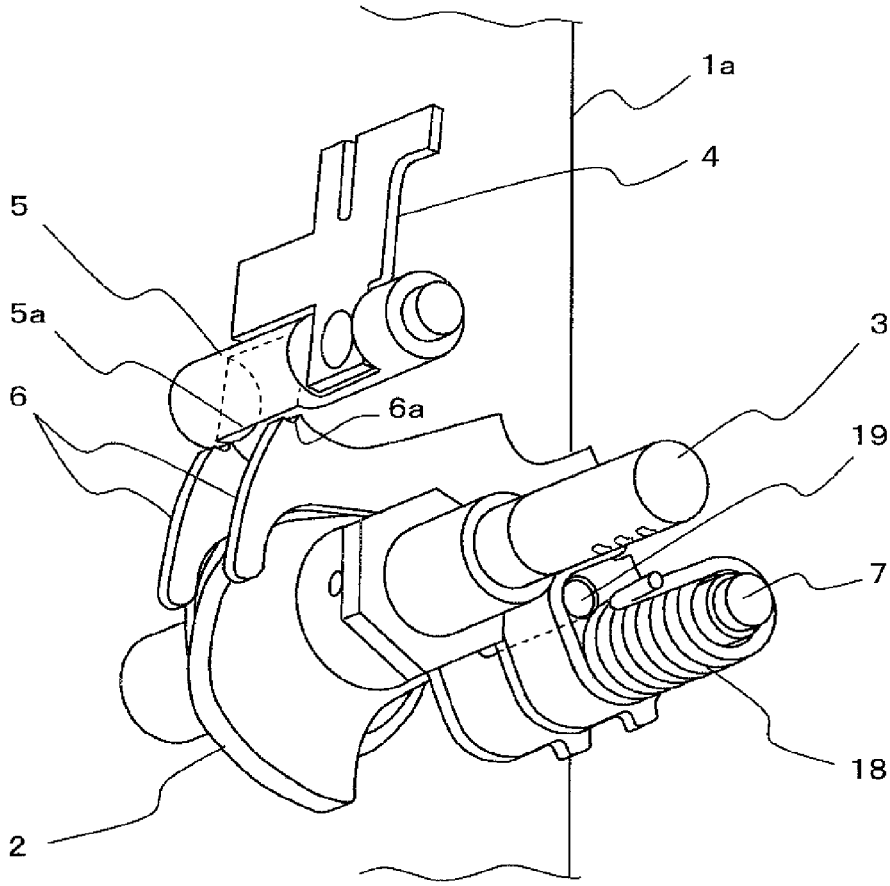
FIG. 2 is a perspective view showing a relevant part (mainly, an energy-storing mechanism portion of a closing drive force) of FIG. 1.

FIG. 2 is a perspective view showing a portion mainly serving as an energy-storing mechanism of the closing drive force, the energy-storing mechanism being located on the upper side and the rear side of the camshaft 3. The drawing shows so that the inside can be seen by excluding the right side frame 1*b* of the two frames 1*a*, 1*b* described in FIG. 1.

The cam 2 is firmly fixed to the camshaft 3 to which the large gear 14 is joined and a drive force is transmitted from the closing spring 16. Two closing levers (to be described in detail later) are arranged on both sides of the cam 2 with a clearance in a manner where the cam 2 is held in sandwiched relation. A latching section 6*a* is formed at one end side of the closing lever 6 and the other end side thereof is firmly fixed to the closing lever shaft 7, so that the closing lever 6 can pivot centering on the closing lever shaft 7. A twist spring 18 is provided on the closing lever shaft 7, one end of the twist spring 18 is hooked on the closing lever 6, and the other end is latched to the frame 1*b* side; and accordingly, the twist spring 18 is biased so as to pivot the closing lever 6 in a counterclockwise direction in the drawing. In this regard, however, a stopper (not shown in the drawing) is provided so that the closing lever 6 does not pivot to the counterclockwise side beyond the position of the drawing.

Furthermore, a pin 19 is provided on the closing levers 6 so as to connect the two closing levers and the pin is disposed at a position where the cam 2 comes into contact with the pin 19 when the camshaft 3 is rotated.

The first semi-circular latch 5 (to be described in detail later) is pivotally provided on the frames 1*a*, 1*b* on the upper side of the camshaft 3. A cutout section 5*a* serving as a latch section is formed at a part of the first semi-circular latch 5, and the first semi-circular latch 5 is disposed so that the cutout section 5*a* is engaged with the latching section 6*a* formed in the closing lever 6. In a normal state (a state where the first semi-circular latch 5 is not engaged with the closing lever 5), the closing lever 6 is biased by the twist spring 18 in a counterclockwise direction so that the latching section 6*a* of the closing lever 6 and the cutout section 5*a* of the first semi-circular latch 5 are retained at a position with a clearance as shown in the drawing. Then, when the closing lever 6 pivots in a clockwise direction in the drawing, the latching section 6*a* is engaged with the cutout section 5*a*.

Furthermore, the driving plate 4 serving as a part to which a drive force for releasing engagement is provided is attached to the first semi-circular latch 5 by a rivet, a bolt, or the like.

Figure 3:
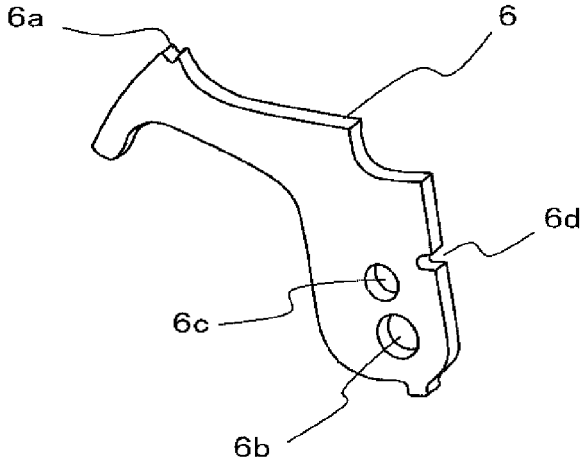
FIG. 3 is a perspective view showing a closing lever of FIG. 2.

FIG. 3 is a perspective view showing the closing lever 6. As shown in the drawing, the latching section 6*a* to be engaged with the before described first semi-circular latch 5 is formed at one end side; and a shaft hole 6*b* to be firmly fixed to the closing lever shaft 7 is formed at the other end side. Furthermore, at a position near the shaft hole 6*b* between the latching section 6*a* and the shaft hole 6*b*, a pin hole 6*c* to which the before described pin 19 is firmly fixed is formed. Incidentally, a cutout section 6*d* is formed for latching the twist spring 18.

Figure 4:
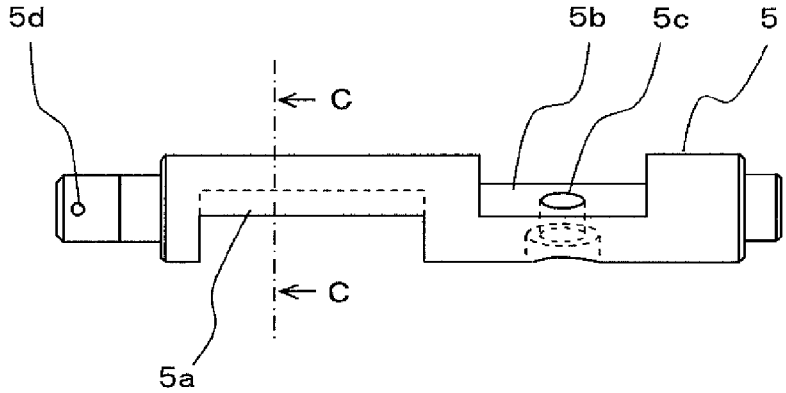
FIG. 4 are views each showing a first semi-circular latch of FIG. 2.
Figure 4:
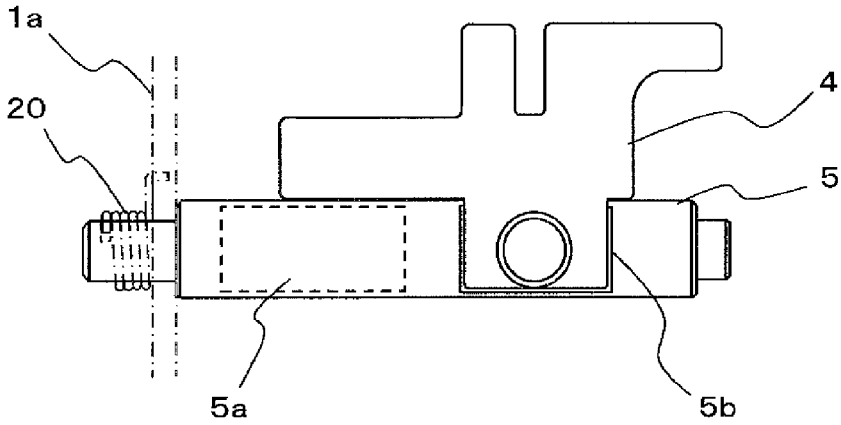
Figure 4:
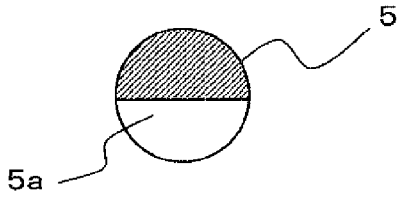

FIG. 4 are views each showing the first semi-circular latch 5, (a) shows an element of the semi-circular latch 5, (b) shows a state where the driving plate 4 is attached to the semi-circular latch 5, and (c) shows a cross-section seen from the line c-c shown in (a).

As shown in (a), the first semi-circular latch 5 is made of a round bar shaped member and is formed with the cutout section 5*a* with a semi-circular shaped cross-section (see (c)) remained by being cut at a part in a longitudinal direction. The axial length of the cutout section 5*a* is larger than the width of the closing levers 6 composed of two plates. A corner section of the cutout section 5*a* is a part serving as an engaging section with the closing lever 6. An attaching section 5*b* and an attaching hole 5*c* to which the driving plate 4 is attached are formed by being similarly cut at a position located opposite (substantially 180 degrees) in a circumferential direction at a position deviated in a longitudinal direction with respect to the cutout section 5*a*.

As shown in (b), the driving plate 4 is fitted in the attaching section 5*b* and firmly fixed with a fastening member such as a rivet or a bolt by utilizing the attaching hole 5*c*.

Incidentally, the shape of the driving plate 4 shows an example and is not limited to the shape of the drawing, but the shape of the driving plate 4 may be appropriately determined on the ground of arrangement or the like of a closing button (to be described later).

Furthermore, the reason why the attaching section 5*b* is formed at the position deviated 180 degrees in the circumferential direction with respect to the cutout section 5*a* is that the first semi-circular latch 5 maintains a balance in mass as much as possible with respect to a rotational shaft, and such deviation is not necessarily limited to 180 degrees.

The first semi-circular latch 5 is made to pivot by pressing the driving plate 4 with the closing button (not shown in the drawing) in releasing operation of engagement; however, after releasing the engagement, in order to reliably return the first semi-circular latch 5 to an original position, a spring attaching hole 5*d* for attaching the twist spring is formed at one shaft end as shown in (a). Further, chamfering is made at the shaft end section thereof so that the shaft end section is easily inserted to the twist spring. As shown by a dashed-dotted line in (b), one end of a twist spring 20 to which the shaft end section is inserted is inserted to the spring attaching hole 5*d* and the other end is latched to the frame 1*a*; and accordingly, a rotational force in an engagement release direction can be provided to the first semi-circular latch 5.

Furthermore, in order to control a pivot range of the first semi-circular latch 5, for instance, means is provided such that a rotational angle is controlled by preliminarily forming a hole on the frame side and by movably disposing a part of the driving plate 4 in the hole. In addition, for instance, means may be provided such that a pin is implanted at a position apart from the cutout section of the latch body and a stopper which is for coming into contact with the pin is used on the frame side.

Next, on the basis of a perspective view of FIG. 5, a description will be made on the configuration of a mechanism portion which is disposed on the front side, the rear side, and the lower side of the camshaft 3 and is mainly related to from closing operation to retaining operation of closing. FIG. 5, also shows so that the inside can be seen by excluding the right side frame 1*b*.

In the drawing, the camshaft 3 is described in FIG. 2; and therefore, the description will be omitted. The output levers 10 composed of two plates are supported by the output lever shaft 11 disposed on the rearward lower side of the camshaft 3, and the output levers 10 pivot centering on the output lever shaft 11.

The following members are placed between the two output levers 10. First, the roller 21 is rotatably provided on the upper side of the output levers 10 and on the front side of the output lever shaft 11. The roller 21 is in a positional relationship that the roller 21 comes into rolling contact with and is pressed by the cam 2 when the cam 2 is rotated. A latch pin 22 is provided on the front side of the roller 21. Then, one end of the output link 17 is pivotally supported on the lower side of the output lever 10.

The rest from the output link 17 is exemplarily shown as an example and is joined to a movable contact 25 of a vacuum valve 24 of the vacuum circuit breaker via a linking mechanism 23. An interrupting spring 26 is provided at an intermediate position of the linking mechanism 23, and the interrupting spring 26 is biased so as to drive the movable contact 25 of the vacuum valve 24 to the opening side. This biasing force serves as a drive force which drives the output link 17 upward.

On the front side of the camshaft 3, the tripping lever pivoting shaft 9 is provided on the frames. One end side of the tripping levers 8 (to be described in detail later) composed of two plate-like members are rotatably supported to the tripping lever pivoting shaft 9. A stepwise latching section 8*a* which is similar to the latching section 6*a* of the closing lever 6 described in FIG. 3 is formed on the other end side of the tripping lever 8.

Then, an intermediate lever 28 whose one end side is supported by a shaft pin 27 is pivotally joined to the tripping levers 8 in a manner where the intermediate lever 28 is held in sandwiched relation between the two tripping levers 8.

The second semi-circular latch 13 is pivotally provided on the frames 1*a*, 1*b* at a position engageable with the latching section 8*a* of the tripping lever 8. The body shape of the second semi-circular latch 13 is equivalent to the first semi-circular latch 5 described in FIG. 4. In this regard, however, the driving plate 12 is not the same as the driving plate 4; and, the shape thereof may be appropriately determined by a pressing direction and the relationship of the arrangement of neighboring members. That is, the different driving plates are used while using the semi-circular latch bodies of the same components; and accordingly, the driving plates can be used for the first semi-circular latch 5 for use in closing operation and the second semi-circular latch 13 for use in tripping operation and a reduction in the number of components can be achieved by sharing the components.

Figure 6:
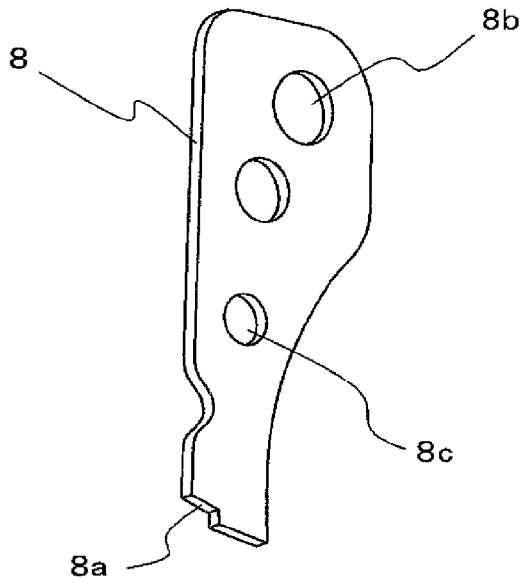
FIG. 6 is a perspective view showing a tripping lever of FIG. 5.

FIG. 6 is a perspective view of the tripping lever 8 and shows only one of two sets. The stepwise latching section 8*a* to be engaged with the second semi-circular latch 13 is formed at one end side; and at the other end side, a shaft hole 8*b* through which the tripping lever pivoting shaft 9 passes through is formed. The before described shaft pin 27 is inserted and fixed to a pin hole 8*c* formed at an intermediate section between the latching section 8*a* and the shaft hole 8*b*, and the intermediate lever 28 is pivotally placed to the shaft pin 27. The function of the intermediate lever 28 will be described later.

Respective configuration has been described above; and next, a description will be made on the operation of the operating mechanism of the present Embodiment.

First, the retaining operation of energy-storing of the closing spring will be described in accordance with FIG. 7 to FIG. 9.

Figure 7:
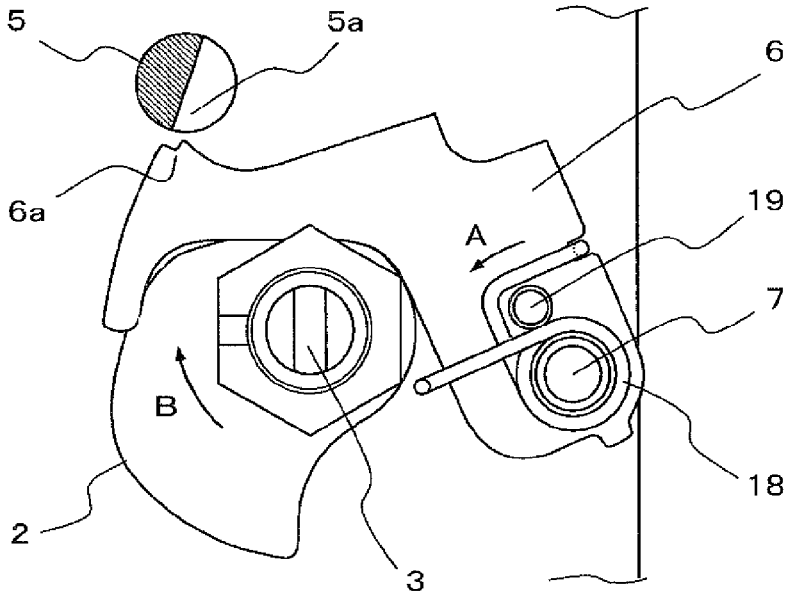
FIG. 7 is a view for explaining the retaining operation of energy-storing of a closing spring of the switch device operating mechanism according to Embodiment 1 of the present invention.
Figure 8:
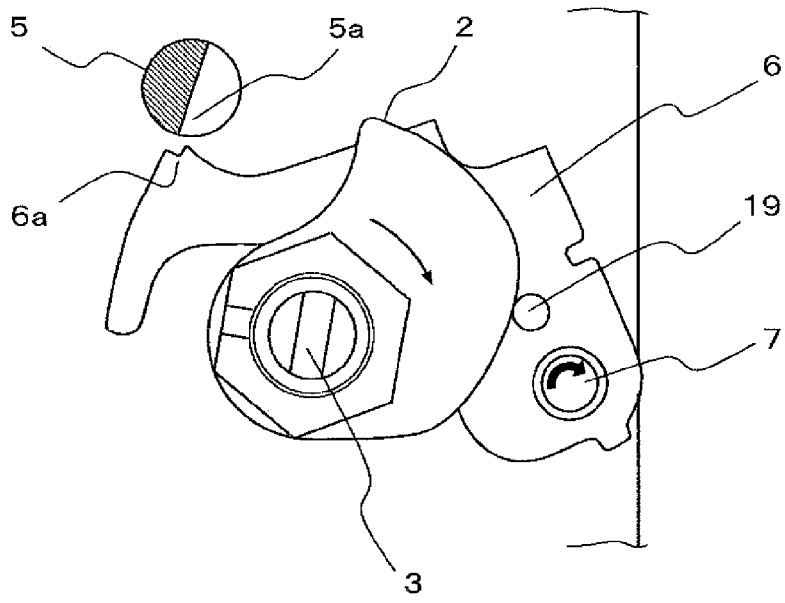
FIG. 8 is a view for explaining the retaining operation of energy-storing of the closing spring of the switch device operating mechanism according to Embodiment 1 of the present invention.

FIG. 7 is a view for explaining a state before the closing operation. The vicinities of the camshaft 3, the closing lever shaft 7, and the first semi-circular latch 5 are extracted and shown (much the same is true on FIGS. 8, 9). An initial state (before entering energy-storing operation) is a state where a clearance exists between the latching section 6*a* of the closing lever 6 and the cutout section 5*a* of the first semi-circular latch 5. That is, the closing lever 6 is biased in an arrow A direction by the function of the twist spring 18 and retained at the position of the drawing.

First, referring to FIG. 1, a description will be made from the operation of the camshaft 3. The large gear 14 is made to rotate in an arrow direction by the drive force of a motor or the like (not shown in the drawing). With this rotation, the crank rod 15 performs crank motion and the closing spring 16 is energy-stored. The rotational force is provided to the large gear 14 by a large load of the energy-stored closing spring 16 at a position beyond a bottom dead center. The camshaft 3 is joined to the large gear 14 and the cam 2 is firmly fixed to the camshaft 3; and therefore, when the rotational force is provided to the large gear 14, the cam 2 is also rotated together with the camshaft 3.

Getting back to FIG. 7, the description will be made. The cam 2 is rotated between the two closing levers 6 in a clockwise manner as shown by an arrow B. When rotation is advanced, as shown in FIG. 8, the cam 2 comes into contact with the pin 19 firmly fixed to the closing lever 6 by the rotation. When the pin 19 receives a load from the cam 2, a torque is generated in a direction of a thick arrow shown in the drawing with respect to the closing lever shaft 7 and the closing lever 6 starts to rotate in a clockwise manner. The force of the twist spring 18 is exerted on the closing lever 6; however, the load by the closing spring 16 overcomes the force, and the closing lever 6 is rotated by the clearance. Then, as shown in FIG. 9, the latching section 6*a* on the end side is engaged with the edge section of the cutout section 5*a* of the first semi-circular latch 5; and accordingly, the movement of the cam 2 and the closing lever 6 is stopped. This state is the retaining of energy-storing which is for maintaining stored energy of the closing spring 16.

At this time, a structure is made such that the distance from a pivot center position of the closing lever 6 to an engaging section between the latching section 6*a* and the cutout section 5*a* of the first semi-circular latch 5 is long and, further, the drive force from the cam 2 is received by the pin 19 near the pivot center; and therefore, a load which receives the first semi-circular latch 5 is one in which the large load by the energy-stored closing spring 16 is reduced, and this is a load reducing mechanism. That is, the large load from the closing spring 16 is not directly received by the latch, but is received by the first semi-circular latch 5 via the closing lever 6.

Furthermore, the distance from the pivot center of the semi-circular latch to the engagement place is short; and therefore, position adjustment of an engagement position is easy.

Next, a description will be made on the closing operation.

The closing operation is performed by releasing the aforementioned retaining state of energy-storing. The release of the retaining state is performed by rotating the first semi-circular latch 5 which is engaged with the closing lever 6. This operation can be easily executed by pushing the driving plate 4 attached to the first semi-circular latch 5 with a closing button made of a coil button or the like (not shown in the drawing) as shown by a thick arrow in FIG. 9.

Figure 9:
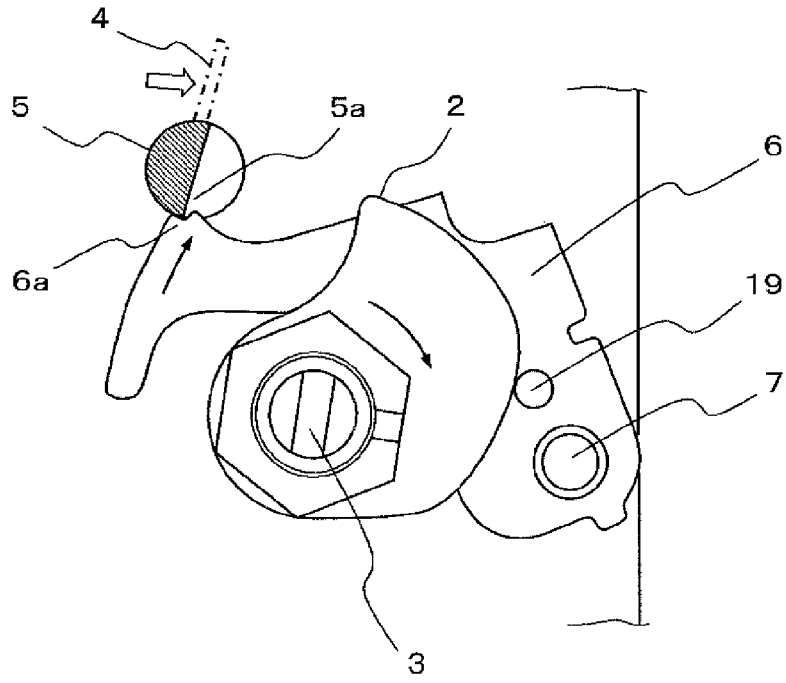
FIG. 9 is a view for explaining the retaining operation of energy-storing of the closing spring of the switch device operating mechanism according to Embodiment 1 of the present invention.
Figure 1:
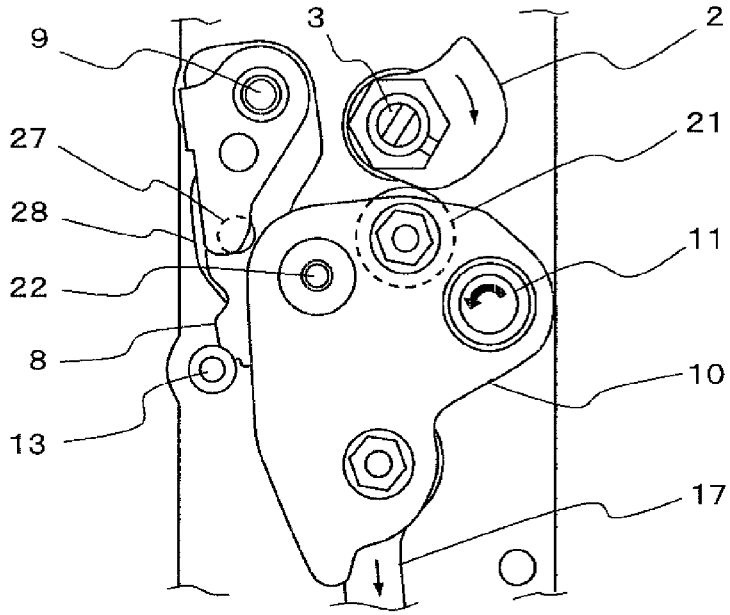
Figure 1:
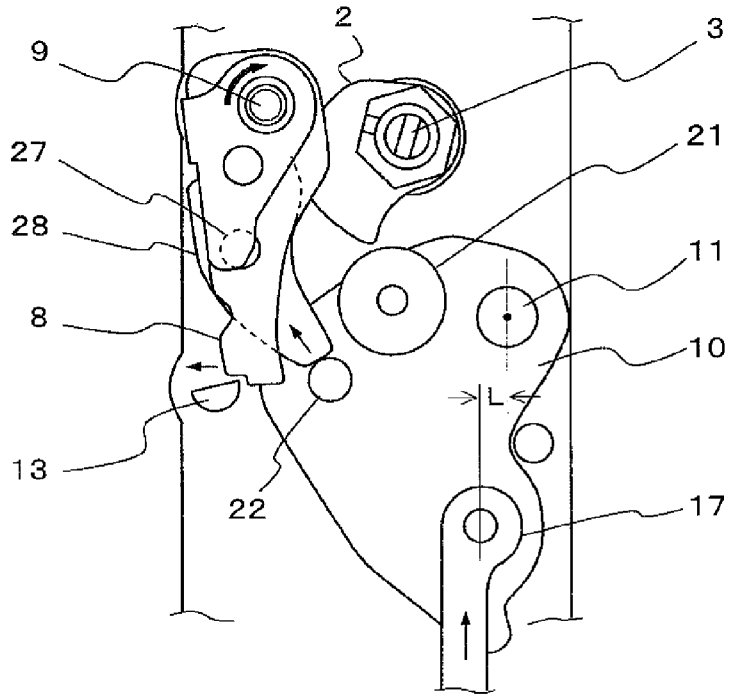
Figure 1:
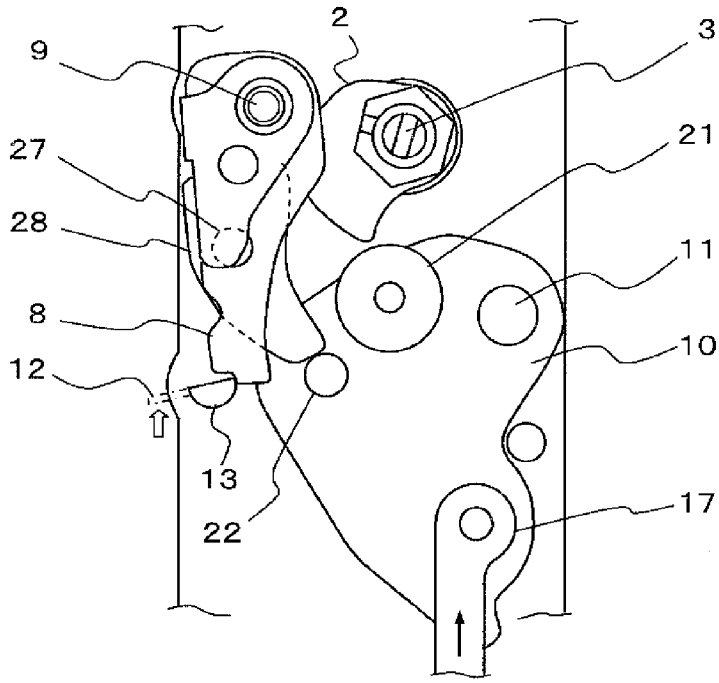
Figure 1:
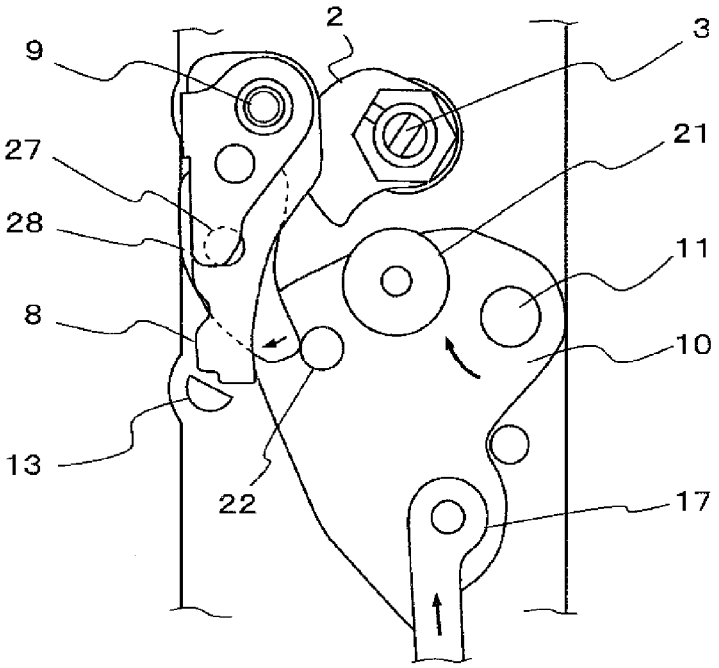

When the engagement between the first semi-circular latch 5 and the closing lever 6 is released from the state of FIG. 9, the pin 19 of the closing lever 6 is pushed by the cam 2; and accordingly, the closing lever 6 is rotated by the drive force in a clockwise direction and the cam 2 can be also rotated in the clockwise direction.

Next, a description will be made from the closing operation to the retaining operation of closing of the vacuum circuit breaker.

FIG. 10 to FIG. 13 are explanation views in which peripheral portions of the camshaft 3, the output lever shaft 11, the tripping lever pivoting shaft 9, and the second semi-circular latch 13 are extracted.

As shown in FIG. 10, when the cam 2 is rotated from the state of FIG. 9, in the next step, the cam 2 comes into contact with the roller 21 placed on the output lever 10 and the cam 2 functions so as to push down the roller 21 while coming into rolling contact with the roller 21. Accordingly, the output lever 10 pivots in a counterclockwise direction centering on the output lever shaft 11 as shown by a thick arrow in FIG. 10; and therefore, the output link 17 joined to the output lever 10 overcomes the biasing force of the interrupting spring 26 and is pushed down downward. The output link 17 is connected to the vacuum valve 24 via the linking mechanism as described in FIG. 5; and therefore, the movable contact 25 of the vacuum valve 24 is closed by the push down operation of the output lever 10 and accordingly the circuit breaker is in a closing state.

Next, a description will be made on the retaining operation of closing.

At the time when the cam 2 is further rotated and is separated from the roller 21, as shown in FIG. 11, an end section of the intermediate lever 28 is engaged with the latch pin 22 to be in a state shown in the drawing. If the cam 2 is separated from the roller 21, the output lever 10 does not receive the drive force from the cam 2 side; and therefore, the output link 17 is driven in an arrow direction by the biasing force of the interrupting spring provided at an intermediate position of the linking mechanism 23 joined to the output link 17 (see FIG. 5), and this serves as a force which makes the output lever 10 rotate in a clockwise direction. Then, the intermediate lever 28 receives a load from the latch pin 22.

Incidentally, the fulcrum of the output link 17 is deviated to the left by L with respect to the center of the output lever shaft 11; and therefore, when the biasing force of the interrupting spring 26 functions, the output lever 10 receives a rotational force in a clockwise direction.

At this time, the intermediate lever 28 is joined to the tripping lever 8 by the shaft pin 27; and therefore, a torque is generated with respect to the tripping lever pivoting shaft 9 by the function of the load and the tripping lever 8 and the intermediate lever 28 integrally pivot in a direction of a thick arrow shown in FIG. 11. By this operation, the tripping lever 8 and the intermediate lever 28 pivot by a clearance between the latching section 8*a* of the tripping lever 8 and a cutout section 13*a* of the second semi-circular latch 13, the latching section 8*a* is engaged with an edge section of the cutout section 13*a* to be in a state shown in FIG. 12, and the closing state is retained.

At this time, the distance from a pivot center position of the tripping lever 8 to the engaging section between the latching section 8*a* of the tripping lever 8 and the cutout section 13*a* of the second semi-circular latch 13 is prolonged and the load is received via the tripping lever 8 and the intermediate lever 28 provided at an intermediate position thereof. Therefore, the load to be received by the second semi-circular latch 13 is one in which the intermediate lever 28 receives from the latch pin is reduced and thus advantageous effects of the aforementioned similar load reduction can be expected.

Next, a description will be made on tripping operation.

The tripping operation of the vacuum circuit breaker is performed by releasing the aforementioned retaining state of closing. The release of the retaining state is performed by rotating the second semi-circular latch 13 engaged with the tripping lever 8. In the case of performing this operation, as in the aforementioned case, execution can be easily performed by pushing the driving plate 12 attached to the second semi-circular latch 13 with a tripping button made of a coil button or the like (not shown in the drawing) in a direction shown by a thick arrow in FIG. 12.

As shown in FIG. 13, when the engagement between the tripping lever 8 and the second semi-circular latch 13 is released by rotating the second semi-circular latch 13, the intermediate lever 28 is pushed by the latch pin 22 to pivot in a clockwise direction; and thus, the engagement between the intermediate lever 28 and the latch pin 22 is released. Accordingly, the output link 17 is pushed up in an arrow direction by the biasing force of the interrupting spring 26, and the contact of the vacuum valve 24 is opened via the linking mechanism 23.

As described above, according to the switch device operating mechanism of Embodiment 1, the switch device operating mechanism includes: the closing spring which provides a closing drive force for closing the contact of the switch device by rotating the camshaft by release of energy; the first semi-circular latch which retains stored energy of the closing spring via the closing lever, the stored energy being transmitted from the camshaft; the output lever which pivots by being pressed by the cam provided on the camshaft when retention by the first semi-circular latch is released and the energy of the closing spring is released, and transmits the closing drive force to the switch device via the linking mechanism; and the second semi-circular latch which prevents the output lever from pivoting in a tripping direction via the tripping lever and retains stored energy of the interrupting spring provided on the linking mechanism, the pivoting of the output lever being caused by transmission of the stored energy of the interrupting spring. Therefore, the semi-circular latch is adopted at a final position which receives a load, and the distance from a pivot center of the semi-circular latch to an engagement place can be shortened; and thus, position adjustment is easy, retention of the stored energy of the closing spring and the interrupting spring can be reliably achieved, and the switch device operating mechanism with high reliability can be obtained.

Furthermore, the load to be exerted on the latch section can be reduced; and thus, the latch can be driven with a small drive force.

Furthermore, the closing lever is formed with the latching section at one end side and the other end side is pivotally supported, and the pin is provided at a position near a pivot center section between the latching section and the pivot center section; and the pin is pushed by rotation of the cam to pivot the closing lever, and the latching section of the closing lever is engaged with the cutout section formed in the first semi-circular latch, whereby, the stored energy of the closing spring is retained. Therefore, the first semi-circular latch receives a load in a state where a large load by the energy-stored closing spring; and thus, the first semi-circular latch can be reduced in size and reducing in size of the operating mechanism can be achieved.

Furthermore, the tripping lever is formed with the latching section at one end side and the other end side is pivotally supported, and the intermediate lever whose one end is pivotally supported by the shaft pin provided at an intermediate section between the latching section and the pivot center section is provided; and the other end side of the intermediate lever is pushed by the latch pin provided on the output lever to pivot the tripping lever by a drive force in which the output lever pivots in the tripping direction by the stored energy of the interrupting spring, and the latching section of the tripping lever is engaged with the cutout section formed on the second semi-circular latch, whereby, the stored energy of the interrupting spring is retained. Therefore, the second semi-circular latch receives a load in a state where a large load by the energy-stored closing spring is reduced; and thus, the second semi-circular latch can be reduced in size and reducing in size of the operating mechanism can be achieved.

Furthermore, the first semi-circular latch and the second semi-circular latch are made of a round bar shaped member, the cutout section is formed with a semi-circular shaped cross-section remained by being cut at a part in a longitudinal direction, and the attaching section of the driving plate which pivots each semi-circular latch is formed with a semi-circular shaped cross-section remained by being cut at a position in the longitudinal direction different from the cutout section. Therefore, the shape of the driving plate is appropriately changed; and accordingly, the same shaped semi-circular latch can be used for closing operation and for tripping operation and components can be shared.

Further, the cutout section and the attaching section formed in each semi-circular latch are formed at positions deviated substantially 180 degrees in the circumferential direction of the round bar shaped semi-circular latch. Therefore, deviation between a pivot center and the center of gravity of the semi-circular latch can be reduced and a moment of inertia can be small.

The invention claimed is:

1. A switch device operating mechanism comprising:

a closing spring which provides a closing drive force for closing a contact of a switch device by rotating a camshaft by release of energy;

a first semi-circular latch which retains stored energy of said closing spring via a closing lever, the stored energy being transmitted from said camshaft;

an output lever which pivots by being pressed by a cam provided on said camshaft when retention by said first semi-circular latch is released and the energy of said closing spring is released, and transmits the closing drive force to said switch device via a linking mechanism;

a second semi-circular latch which prevents said output lever from pivoting in a tripping direction via a tripping lever and retains stored energy of an interrupting spring provided on said linking mechanism, the pivoting of said output lever being caused by transmission of the stored energy of said interrupting spring;

wherein said closing lever is formed with a latching section at one end side and the other end side is pivotally supported, and a pin is provided at a position near a pivot center section between the latching section and the pivot center section; and said pin is pushed by rotation of said cam to pivot said closing lever, and the latching section of said closing lever is engaged with a cutout section formed on said first semi-circular latch, whereby, the stored energy of said closing spring is retained.

2. A switch device operating mechanism comprising:

a closing spring which provides a closing drive force for closing a contact of a switch device by rotating a camshaft by release of energy;

a first semi-circular latch which retains stored energy of said closing spring via a closing lever, the stored energy being transmitted from said camshaft;

an output lever which pivots by being pressed by a cam provided on said camshaft when retention by said first semi-circular latch is released and the energy of said closing spring is released, and transmits the closing drive force to said switch device via a linking mechanism;

a second semi-circular latch which prevents said output lever from pivoting in a tripping direction via a tripping lever and retains stored energy of an interrupting spring provided on said linking mechanism, the pivoting of said output lever being caused by transmission of the stored energy of said interrupting spring;

wherein said tripping lever is formed with a latching section at one end side and the other end side is pivotally supported, and an intermediate lever whose one end is pivotally supported by a shaft pin provided at an intermediate section between the latching section and a pivot center section is provided; and the other end side of said intermediate lever is pushed by a latch pin provided on said output lever to pivot said tripping lever by a drive force in which said output lever pivots in the tripping direction by the stored energy of said interrupting spring, and the latching section of said tripping lever is engaged with a cutout section formed on said second semi-circular latch, whereby, the stored energy of said interrupting spring is retained.

3. The switch device operating mechanism according to claim 1, wherein said first semi-circular latch is made of a round bar shaped member, the cutout section is formed with a semi-circular shaped cross-section remained by being cut at a part in a longitudinal direction, and an attaching section of a driving plate which pivots said first semi-circular latch is formed with a semi-circular shaped cross-section remained by being cut at a position in the longitudinal direction different from the cutout section.

4. The switch device operating mechanism according to claim 3, wherein the cutout section and the attaching section formed in said first semi-circular latch are formed at positions deviated substantially 180 degrees in the circumferential direction of said round bar shaped first semi-circular latch.

5. The switch device operating mechanism according to claim 2, wherein said second semi-circular latch is made of a round bar shaped member, the cutout section is formed with a semi-circular shaped cross-section remained by being cut at a part in a longitudinal direction, and an attaching section of a driving plate which pivots said second semi-circular latch is formed with a semi-circular shaped cross-section remained by being cut at a position in the longitudinal direction different from the cutout section.

6. The switch device operating mechanism according to claim 5, wherein the cutout section and the attaching section formed in said second semi-circular latch are formed at positions deviated substantially 180 degrees in the circumferential direction of said round bar shaped second semi-circular latch.

7. The switch device operating mechanism according to claim 6, wherein said second semi-circular latch is formed in the same shape as said first semi-circular latch.

* * * * *